US008687989B2

(12) United States Patent
Zaretsky

(10) Patent No.: US 8,687,989 B2
(45) Date of Patent: Apr. 1, 2014

(54) TRANSFER UNIT WITH COMPENSATION FOR VARIATION

(75) Inventor: Mark Cameron Zaretsky, Rochester, NY (US)

(73) Assignee: Eastman Kodak Company, Rochester, NJ (US)

( * ) Notice: Subject to any disclaimer, the term of this patent is extended or adjusted under 35 U.S.C. 154(b) by 207 days.

(21) Appl. No.: 13/406,557

(22) Filed: Feb. 28, 2012

(65) Prior Publication Data

US 2013/0136475 A1 May 30, 2013

Related U.S. Application Data

(63) Continuation-in-part of application No. 13/305,805, filed on Nov. 29, 2011, now abandoned.

(51) Int. Cl.
*G03G 15/16* (2006.01)
*G03G 15/01* (2006.01)

(52) U.S. Cl.
USPC ..... 399/66; 399/302

(58) Field of Classification Search
USPC ..... 399/66, 302
See application file for complete search history.

(56) References Cited

U.S. PATENT DOCUMENTS

| | | | | |
|---|---|---|---|---|
| 5,276,483 | A * | 1/1994 | Hasegawa et al. | 399/44 |
| 5,291,253 | A * | 3/1994 | Kumasaka et al. | 399/66 |
| 5,300,984 | A * | 4/1994 | Fuma et al. | 399/66 |
| 5,953,556 | A | 9/1999 | Yamanaka | |
| 6,029,022 | A * | 2/2000 | Takase | 399/66 |
| 6,334,032 | B1 * | 12/2001 | Tomiki | 399/66 |
| 6,766,123 | B2 * | 7/2004 | Ebihara et al. | 399/66 |
| 6,947,679 | B2 * | 9/2005 | Kato et al. | 399/45 |
| 7,379,694 | B2 | 5/2008 | Takiguchi et al. | |
| 7,742,729 | B2 | 6/2010 | Sawai | |
| 2013/0078014 | A1 * | 3/2013 | Ogiyama | 399/315 |

* cited by examiner

*Primary Examiner* — G. M. Hyder
(74) *Attorney, Agent, or Firm* — Christopher J. White

(57) ABSTRACT

A transfer unit includes a rotatable static-dissipative member with a time-varying electrical property. A second member selectively transfers toner to or from the static-dissipative member. A power source selectively produces an electrostatic transfer field between the static-dissipative member and the second member, so that toner is transferred between the static-dissipative member and the second member. A charger spaced apart from the static-dissipative member selectively deposits charge thereon. A control system successively drives a plurality of different selected voltages or currents through the charger and measures a plurality of respective resulting charger currents or voltages. It uses the selected voltages or currents and the respective charger currents or voltages to automatically estimate a variation in the electrical property. It then causes the power source to produce an electric transfer field that transfers toner and compensates for the estimated variation.

10 Claims, 5 Drawing Sheets

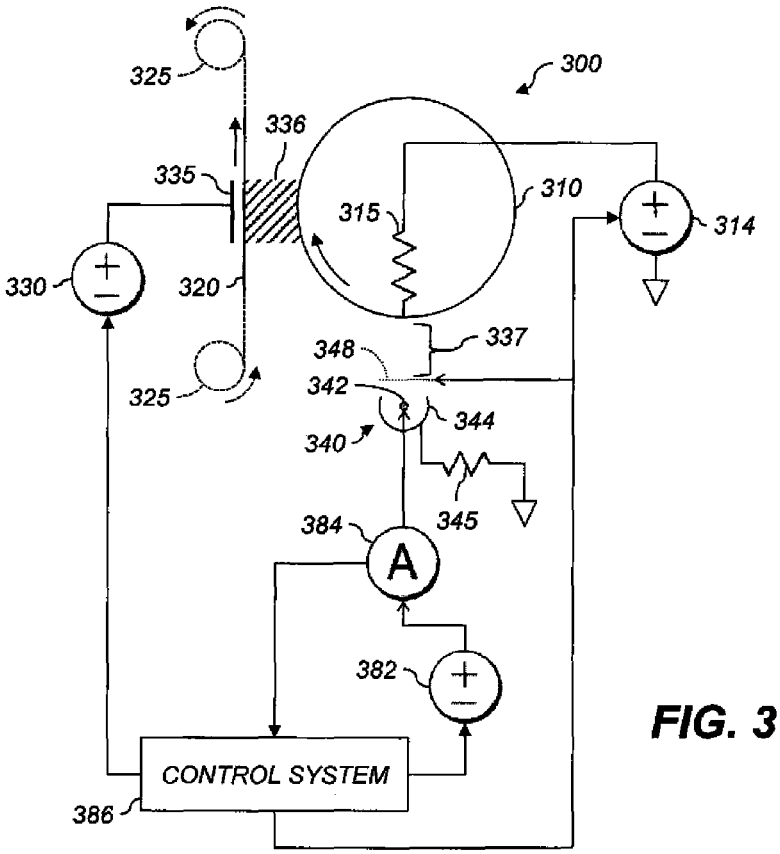
FIG. 3
FIG. 4
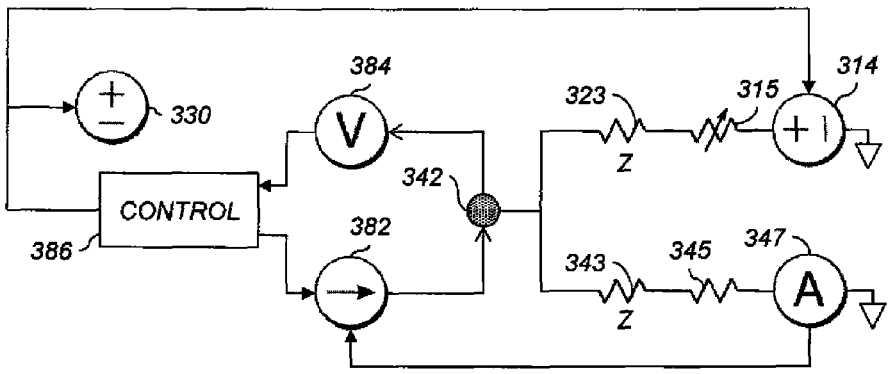

TRANSFER UNIT WITH COMPENSATION FOR VARIATION

CROSS-REFERENCE TO RELATED APPLICATIONS

This application is a continuation-in-part of prior U.S. patent application Ser. No. 13/305,805, filed Nov. 29, 2011 now abandoned by Mark C. Zaretsky, titled "TRANSFER UNIT WITH COMPENSATION FOR VARIATION," which is hereby incorporated herein by reference in its entirety.

FIELD OF THE INVENTION

This invention pertains to the field of electrophotographic printing and more particularly to compensating for performance variations over time.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

Toner is transferred between members in the printer using electrostatic forces. Variations in the electrical properties of transferring members will result in variations in transfer efficiency. These variations can cause an incorrect amount of toner to be transferred, producing nonuniformities and reducing image quality. Moreover, variations over time can gradually degrade overall transfer performance, resulting in prints that do not consistently produce the expected density.

Various schemes have been proposed to deal with these problems. For example, U.S. Pat. No. 7,742,729 to Sawai describes selecting a transfer member which changes resistance sufficiently slowly to remain within an acceptable range over the printing of 200,000-300,000 copies. Sawai also describes testing a transfer member by cycling voltage across an intermediate transfer medium. However, this testing requires mechanical contact with the intermediate transfer medium, which can lead to increased contamination on the surface of the transfer member or other members if this test is performed in the printer. In related schemes, resistance changes of transferring members have been measured by measurement rollers brought into contact with those members. However, these schemes can also lead to increased wear and contamination on the surface of the members. Another scheme, U.S. Pat. No. 5,953,556 to Yamanaka, describes measuring transfer current through the transfer member and transfer voltage to determine resistance. However, the results of this method are affected by the toner pattern being printed. As printers move towards higher printing speeds and smaller lead edge margins, including full-page bleed printing, there is insufficient time available to measure resistance in a non-print region. The resistance measurement will also depend upon the properties of the photoreceptor, which may change with time. For example, the thickness of a photoreceptor typically decreases with age due to abrasion of a blade cleaner.

There is a continuing need, therefore, for a way of measuring the electrical properties of members that transfer toner.

SUMMARY OF THE INVENTION

According to an aspect of the present invention, there is provided a transfer unit, comprising:

a) a rotatable static-dissipative member having a time-varying electrical property;

b) a second member adapted to transfer toner to or from the static-dissipative member;

c) a control system;

d) a power source responsive to the control system for selectively producing an electrostatic transfer field between the static-dissipative member and the second member, so that toner is transferred between the static-dissipative member and the second member; and e) a charger spaced apart from the static-dissipative member and adapted to selectively deposit charge thereon in response to the control system;

f) the control system being adapted to:

i) successively drive a plurality of different selected voltages or currents through the charger and measure a plurality of respective resulting charger currents or voltages;

ii) using the selected voltages or currents and the respective charger currents or voltages, automatically estimate a variation in the electrical property; and iii) cause the power source to produce an electric transfer field that transfers toner and compensates for the estimated variation.

An advantage of this invention is that it measures electrical properties without mechanical contact. This reduces the probability of contamination of either the toner-transferring members or the measurement apparatus. In various embodiments, these measurements permit selecting an appropriate transfer bias, thereby improving image quality and increasing robustness to variations in factors that can alter these electrical properties (e.g., temperature, relative humidity, and manufacturing tolerances). Various embodiments permit correcting for machine-to-machine geometry variations such as in the gap between the measurement apparatus and the toner-transferring member.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIG. 3 shows transfer apparatus according to various embodiments;

FIG. 4 is an equivalent circuit diagram of various components shown in FIG. 3;

Figure 1:
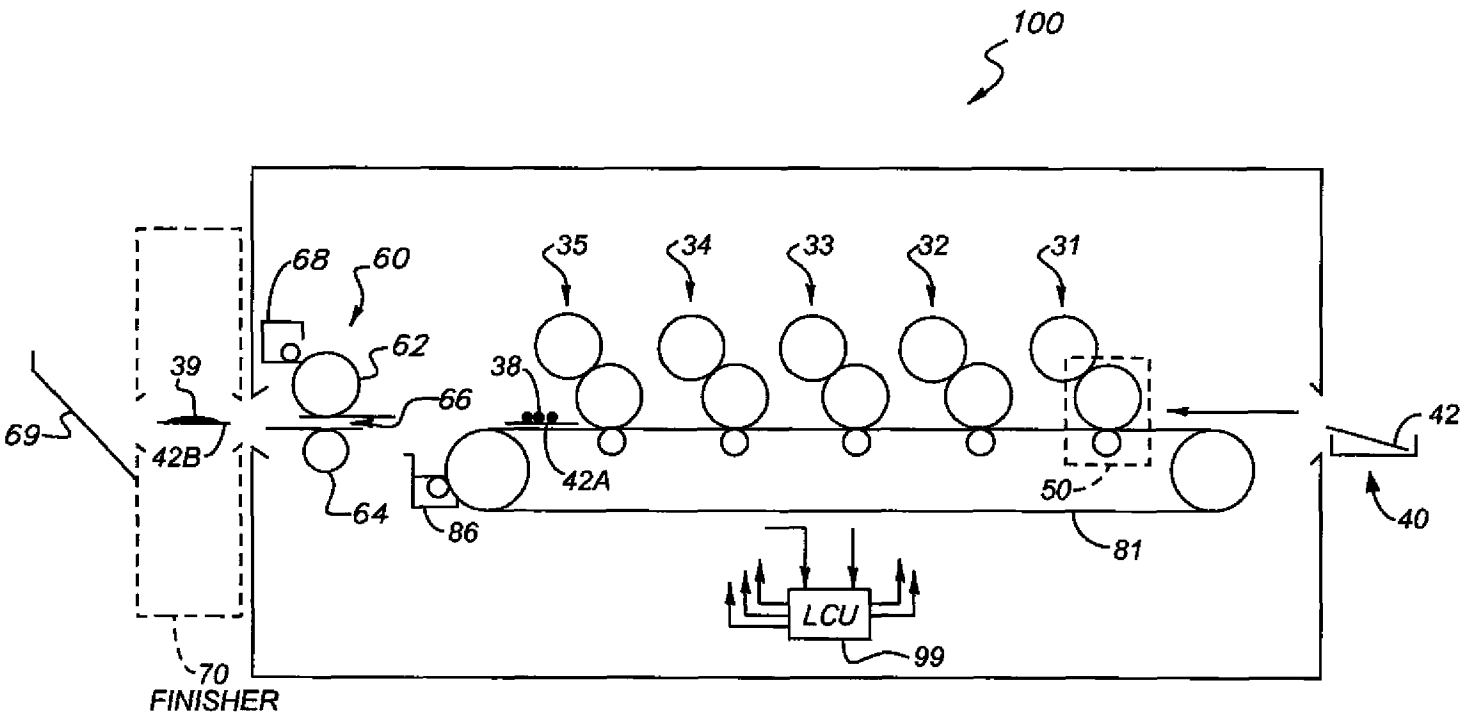
FIG. 1 is an elevational cross-section of an electrophotographic reproduction apparatus according to an embodiment.

The attached drawings are for purposes of illustration and are not necessarily to scale.

DETAILED DESCRIPTION OF THE INVENTION

In the following description, some embodiments will be described in terms that would ordinarily be implemented as software programs. Those skilled in the art will readily recognize that the equivalent of such software can also be constructed in hardware. Because data-manipulation algorithms and systems are well known, the present description will be directed in particular to algorithms and systems forming part of, or cooperating more directly with, methods described herein. Other aspects of such algorithms and systems, and hardware or software for producing and otherwise processing data signals involved therewith, not specifically shown or described herein, are selected from such systems, algorithms, components, and elements known in the art. Given the system as described herein, software not specifically shown, suggested, or described herein that is useful for implementation of various embodiments is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods according to various embodiments.

The electrophotographic (EP) printing process can be embodied in devices including printers, copiers, scanners, and facsimiles, and analog or digital devices, all of which are referred to herein as "printers." Electrostatographic printers such as electrophotographic printers that employ toner developed on an electrophotographic receiver can be used, as can ionographic printers and copiers that do not rely upon an electrophotographic receiver. Electrophotography and sonography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

Figure 2:
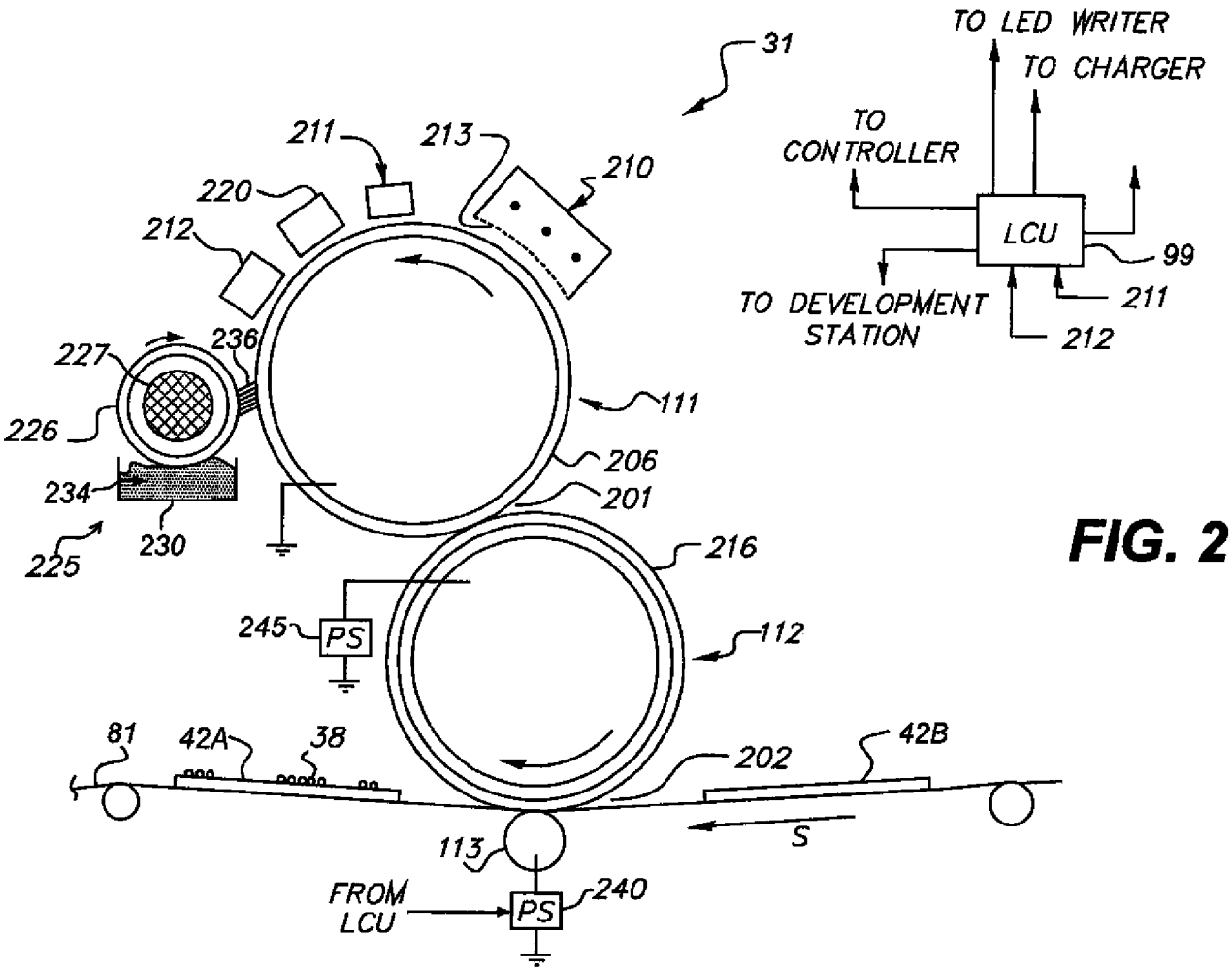
FIG. 2 is an elevational cross-section of the reprographic image-producing portion of the apparatus of FIG. 1.

FIGS. 1 and 2 are elevational cross-sections showing portions of a typical electrophotographic printer 100. Printer 100 is adapted to produce print images, such as single-color (monochrome), CMYK, or pentachrome (five-color) images, on a receiver (multicolor images are also known as "multicomponent" images). Images can include text, graphics, photos, and other types of visual content. An embodiment involves printing using an electrophotographic print engine having five sets of single-color image-producing or -printing stations or modules arranged in tandem, but more or less than five colors can be combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver 42, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver 42, during a single pass through the five printing modules 31, 32, 33, 34, 35, can have transferred in registration thereto up to five single-color toner images to form a pentachrome image. As used herein, the term "pentachrome" implies that in a print image, combinations of various of the five colors are combined to form other colors on receiver 42 at various locations on receiver 42. That is, each of the five colors of toner can be combined with toner of one or more of the other colors at a particular location on receiver 42 to form a color different than the colors of the toners combined at that location. In an embodiment, printing module 31 forms black (K) print images, 32 forms yellow (Y) print images, 33 forms magenta (M) print images, 34 forms cyan (C) print images, and 35 forms clear-toner images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images 38, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers (e.g., 42A) to fuser 60, which fixes the toner particles to the respective receivers 42A by the application of heat and pressure. The receivers 42A are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver 42. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 200610133870, published on Jun. 22, 2006, by Yee S. Ng et al., the disclosures of which are incorporated herein by reference.

FIG. 2 shows more details of printing module 31, which is representative of printing modules 32, 33, 34, and 35 (FIG. 1). Primary charging subsystem 210 uniformly electrostatically charges photoreceptor 206 of imaging member 111, shown in the form of an imaging cylinder. Charging subsystem 210 includes a grid 213 having a selected voltage. Additional components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g., laser or LED writers), and the respective development station 225 of each printing module 31, 32, 33, 34, 35 (FIG. 1), among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g., of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, some or all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 (FIG. 1) which the light source (e.g., laser or LED) can expose with a selected exposure different from the exposure of another engine pixel. Engine pixels can overlap, e.g., to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power source (not shown). Developer is provided to toning shell 226 by a supply system (not shown), e.g., a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. Development station 225 can also employ a mono-component developer comprising toner, either magnetic or non-magnetic, without separate magnetic carrier particles.

As used herein, the term "development member" refers to the member(s) or subsystem(s) that provide toner to photoreceptor 206. In an embodiment, toning shell 226 is a development member. In another embodiment, toning shell 226 and magnetic core 227 together compose a development member.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g., 42B) which receives the respective toned print images 38 from each printing module in superposition to form a composite image thereon. Print image 38 is e.g., a separation of one color, such as cyan. Receivers are transported by transport web 81. Print images are transferred from photoreceptor 206 to intermediate transfer member 112 by an electrical field provided between imaging member 111 and intermediate transfer member 112. In various embodiments, a conductive core of imaging member 111 is grounded and a core of intermediate transfer member 112 is connected to power source 245 (controlled by LCU 99), which applies a bias to the core of intermediate transfer member 112. In other embodiments, both cores are biased, or only that of the imaging member, or both cores are biased to different voltages. Print images are transferred from intermediate transfer member 112 to receiver 42B by an electrical field established by biasing transfer backup member 113 with power source 240, which is controlled by LCU 99. In various embodiments, during transfer to receiver 42B, power source 245 biases the core of intermediate transfer member 112 to a constant voltage. In various embodiments, the same bias from power source 245 is used for transfer from photoreceptor 206 to intermediate transfer member 112 and from intermediate transfer member 112 to receiver 42B. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Still referring to FIG. 2, toner is transferred from toning shell 226 to photoreceptor 206 in toning zone 236. As described above, toner is selectively supplied to the photoreceptor by toning shell 226. Toning shell 226 receives developer 234 from developer supply 230, which can include a mixer. Developer 234 includes toner particles and carrier particles.

FIG. 3 shows transfer apparatus according to various embodiments.

Transfer unit 300 includes rotatable static-dissipative member 310 connected to power source 314. Member 310 has a time-varying electrical property, e.g., resistance. The time-varying electrical property can vary overall, e.g., because of changes in temperature and humidity. The property can also vary over time at a selected measurement point, e.g., because of non-uniformity in member 310 that leads to changes in the property at the measurement point as member 310 rotates. In the example shown here, the property is resistance 315 to power source 314. Resistance 315 is the inherent resistance of member 310, or its surface (e.g., a compliant blanket entrained around or deposited on the surface of member 310). Resistance 315 can also be the resistance between the surface of member 310 and a conductive core thereof, and power source 314 can be connected to the conductive core. Static-dissipative member 310 can be a roller or a belt. In various embodiments, static-dissipative member 310 has one or more static-dissipative coverings. "Static-dissipative" means that the volume resistivity of the covering(s) falls in the range of $10^6$ to $10^{12}$ Ω-cm or the surface resistance of the covering(s) falls in the range of $10^7$ to $10^{13}$Ω/□.

Second member 320 is adapted to transfer toner to or from the static-dissipative member. Second member 320 can be planar or non-planar, and movable or rotatable.

In an embodiment, static-dissipative member 310 is a blanket cylinder (e.g., transfer member 112, FIG. 2), second member 320 is a photoreceptor drum or web (e.g., imaging member 111, FIG. 2), and toner is transferred from second member 320 to static-dissipative member 310. In this embodiment, member 310 includes a metal core. A compliant, 10 mm thick, elastomeric static-dissipative covering such as a polyurethane containing an antistatic agent is disposed over the metal core, and a relatively non-compliant, thin (6 μm) static-dissipative release layer such as a ceramer is applied over the elastomeric covering. Examples of such a multi-layered static-dissipative member are given in U.S. Pat. No. 5,948,585. If second member 320 is a web photoreceptor, the photoreceptor is entrained around rollers 325 to permit it to rotate.

In another embodiment, static-dissipative member 310 is a blanket cylinder, and second member 320 is a receiver (e.g., receiver 42B, FIG. 2). Toner is transferred from static-dissipative member 310 to second member 320 (the receiver). In this embodiment, member 310 is as described above. Member 320 can be supported by a backup belt (e.g., as shown in FIG. 2) or roller.

Control system 386 controls transfer unit 300. Control system 386 can include a processor, FPGA, PLD, PAL, PLA, or other logic or processing unit. The functions of control system 386 will be discussed further below. Control system 386 can include or be associated with components it controls and responds to. Control system 386 can be part of or separate from LCU 99 (FIG. 1).

Power sources 314, 330 are responsive to control system 386 and selectively produce electrostatic transfer fields. The field extends between static-dissipative member 310 and electrode 335 located behind second member 320. Electrode 335 can be a roller; it can also be a plate or other member in sliding contact with second member 320. Electrode 335 can also be a conductive layer beneath a photoconductive layer. In the embodiment described above in which second member 320 is a photoreceptor, power source 330 can be grounded. In the embodiment described above in which second member 320 is a receiver, power sources 314, 330 can be set to respective voltages to pull toner off of static-dissipative member 310. For example, for a negatively charger toner, a more positive voltage can be applied by power source 330 than applied by power source 314.

The electrostatic transfer field produced by power sources 314 or 330 causes toner to be transferred between static-dissipative member 310 and second member 320 in transfer zone 336. Other substances capable of holding electrostatic charge when in particulate form can also be transferred. As used herein, the term "toner" includes such substances. In an example, power source 314 applies a voltage bias to the core of member 310. That is, power sources 314 or 330 (or both) produce a selected voltage difference between static-dissipative member 310 and second member 320. This is similar to power source 240 and transfer backup member 113 (both FIG. 2). Power source 330 can also be a current supply. In various embodiments, power source 314 or 330 can apply voltage or current directly to second member 320, or to static-dissipative member 310, or to both. In various embodiments, power source 314 or 330 produces a selected current between static-dissipative member 310 and second member 320.

Charger 340 is also responsive to the control system. Charger 340 is spaced apart from static-dissipative member 310 by gap 337. Charger 340 selectively deposits charge on static-dissipative member 310. In the example shown, charger 340 includes a corona charger including corona wire 342 partly surrounded by shell 344, which is at least partly conductive. A resistor with resistance 345 connects shell 344 to ground (or another selected voltage). High voltage of a given polarity applied to corona wire 342 causes charge of the same polarity to be showered onto the surface of static-dissipative member 310. Some charge also strikes shell 344, as discussed below. In some embodiments, a bias applied to grid 348 by control system 386 or components responsive thereto (not shown) controls the amount of charge reaching static-dissipative member 310. In some embodiments, charger 340 includes a static string or pin charger.

Source 382, in response to control system 386, successively drives a plurality of different selected voltages or currents through charger 340. In the example shown, source 382 is a voltage source; it can also be a current source. Meter 384 measures a plurality of respective resulting charger currents or voltages corresponding to the different selected voltages or currents. In the example shown, meter 384 is an ammeter in series with source 382; if source 382 is a current source, meter 384 is a voltmeter, e.g., measuring the voltage on corona wire 342.

Control system 386 uses the selected voltages or currents and the respective charger currents or voltages to automatically estimate a variation in the electrical property. An example of this estimation is given below with respect to FIG. 4. Control system 386 then causes power source 314 to produce an electric transfer field that transfers toner and compensates for the estimated variation. This can be performed to compensate in real time for variations.

In various embodiments, control system 386 further averages multiple estimates of the variation of the electrical property. The averages can be arithmetic or geometric, and can be weighted or not. Control system 386 then causes power source 314 to produce an electric transfer field that transfers toner and compensates for the averaged estimated variation. Control system 386 can also compensate for variations as soon as they are measured. These variations can occur across a large range of timescales, from minutes (due to temperature changes as components warm up) to hours (due to humidity changes as components equilibrate to the ambient humidity). The magnitude of the variation in an electrical property such as volume resistivity can be about 3× to about 10× as the environment changes from cold and dry (60° F. and 10% RH) to hot and wet (85° F. and 70% RH). This type of variation can be much larger than a manufacturing tolerance on volume resistivity, which can be between 10% and 200%.

FIG. 4 is a circuit diagram of various components shown in FIG. 3. Control system 386, power sources 314, 330, source 382, meter 384, corona wire 342, resistance 315, and resistance 345 are as in FIG. 3. Impedance 323 is the impedance of the resistive-capacitive coupling across the air gap between charger 340 and the surface of static-dissipative member 310, and depends on the geometry of the charger and the surface, the operating current/voltage on corona wire 342, the resistances 345 and 315, and the ambient temperature, relative humidity and atmospheric pressure. Impedance 343, similarly, is the impedance of the resistive-capacitive coupling across the air gap between corona wire 342 and the inside of shell 344, and depends upon the same set of parameters as listed above. In various embodiments, the equivalent circuit of impedances 323 or 343 can include a capacitor in parallel with a series combination of a Zener diode and a resistor.

The embodiment shown uses a current supply as source 382 and a parallel voltmeter as meter 384, but other embodiments use a voltage supply as source 382 and a series ammeter as meter 384 (e.g., as shown in FIG. 3). In the example shown, the electrical property is resistance 315 between the surface of static-dissipative member 310 and the core of member 310. Resistance 315 is shown as a variable resistor to graphically indicate this. In various embodiments, the parameter also varies with temperature and humidity, since the intrinsic resistivity of the static-dissipative covering is sensitive to these variables.

In the following description, $V_x$ is the voltage across component x, $V_{m,x}$ the voltage measured by meter x, $I_x$ the current through component x, and $I_{m,x}$ the current measured by meter x. $R_x$ or $Z_x$ are the resistance (impedance) of component x. As used throughout this disclosure, the terms "constant current" and "constant voltage" mean current or voltage (respectively) maintained within selected tolerances, as known by one skilled in the art.

When source 382 applies a voltage to corona wire 342 that exceeds the corona onset threshold, current flows from wire 342 to shell 344 (FIG. 3) and the surface of static-dissipative member 310 (FIG. 3). Current meter 347 monitors $I_{345}=I_{m,347}$, the current flowing through the shell back to ground. In response to the measurement from current meter 347, source 382 maintains a constant current $I_{323}$ deposited onto member 310. That is, source 382 provides current $I_{382}$ to corona wire 342 so that $I_{323}=I_{315}=I_{382}-I_{m,347}$ is held within a selected tolerance, e.g., ±1%. This will result in corona wire 342 being raised to a corresponding wire voltage $V_{342}=V_{m,384}$. The potential difference between the wire voltage and the bias on the core of member 310 is $\Delta V_1=V_{m,384}-V_{314}$. For a given current $I_{315}$ deposited onto member 310 having an impedance value $Z_{315}$, there is a unique potential difference $\Delta V_1$. In the embodiment shown here, current-voltage-resistance triplets $I_{315}-\Delta V_1-Z_{315}$ are determined in advance and stored in a lookup table. A lookup table is used because impedances $Z_{323}$ and $Z_{343}$ are not simple resistances, and, in some embodiments, are not amenable to closed-form solutions for impedance in terms of voltage and current.

Resistance 315 can thus be determined from $V_{m,384}$ and $I_{315}$.

In various embodiments, $Z_{343}$ and $Z_{323}$ change with temperature, relative humidity, or pressure, as discussed above. In some of these embodiments, the respective V-I characteristics across $Z_{343}$ and $Z_{323}$ are measured at various environmental conditions, and separate LUTs are stored for each set of conditions. In others of these embodiments, a coefficient or multiplicative factor is applied to the original LUT to compensate for variations in environmental conditions. For LUT L indexed by an environmental condition cond and a V/I value:

$$Z_{315}=L[\text{cond}, \Delta V_1, I_{315}].$$

In various embodiments, another source of variation is gap 337 between charger 340 and member 310. This gap can vary from machine to machine, affecting $Z_{323}$ and $Z_{343}$, and therefore affecting the relationship between $I_{315}$, $\Delta V_1$, and $Z_{315}$. $Z_{343}$ is affected because changing gap 337 also changes the capacitive coupling between wire 342 and shell 344. This can change the corona onset voltage or electric field distribution, resulting in different impedance characteristics. With $Z_{323}$ and $Z_{323}$ varying, there is no unique $Z_{315}$ corresponding to a given $I_{315}$ and $\Delta V_1$. Resistance 315 also depends on the size of gap 337 (FIG. 3), denoted $G_{337}$. In these embodiments, before operating the printer, $\Delta V_1$ values are measured at several $I_{315}$ conditions for multiple gap spacings $G_{337}$ and test resistances $Z_{t,315}$. A slope S and intercept I are then computed from the $\Delta V_1$-$I_{315}$ data for each test condition. Each (S, I) pair then corresponds to only one ($G_{337}$, $Z_{t,315}$) pair.

Tuples of (S, I, $G_{337}$, $Z_{t,315}$) are determined in advance and stored, e.g., in a lookup table. At runtime, both resistance 315 and geometry such as charger gap are determined by measuring voltage and current at two or more points, fitting a linear trend line to those points and determining the slope and intercept of the trend line, and indexing the lookup table with the determined slope and intercept to retrieve the resistance and gain. The lookup table can also be indexed by environmental conditions.

Figure 5:
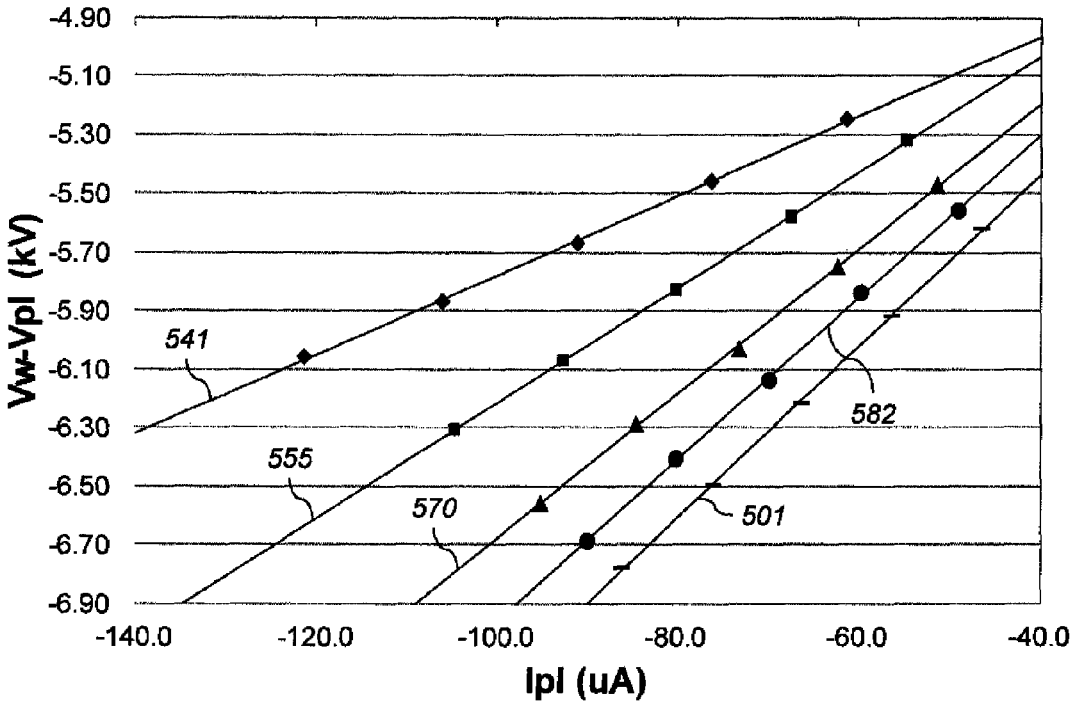
FIG. 5 shows a hypothetical example of gap spacing and resistance.

FIG. 5 shows a hypothetical example of gap spacing and resistance. A conductive metal plate can be spaced apart from a corona charger. The conductive plate can be connected by a resistor to a high voltage power source capable of sinking current while maintaining a constant voltage, simulating biased static-dissipative member 310 (FIG. 3). Current can be driven through the charger, as described above with respect to FIG. 4. The abscissa of this plot is plate current in μA, corresponding to $I_{315}$. The ordinate is the difference between wire voltage and plate voltage, corresponding to $\Delta V_1$. Curves 541, 555, 570, 582, 501 are linear trend lines of the plotted voltage data as a function of current. Curves 541, 555, 570, 582, 501 show data for five hypothetical resistances $R_{315}$.

Figure 6A:
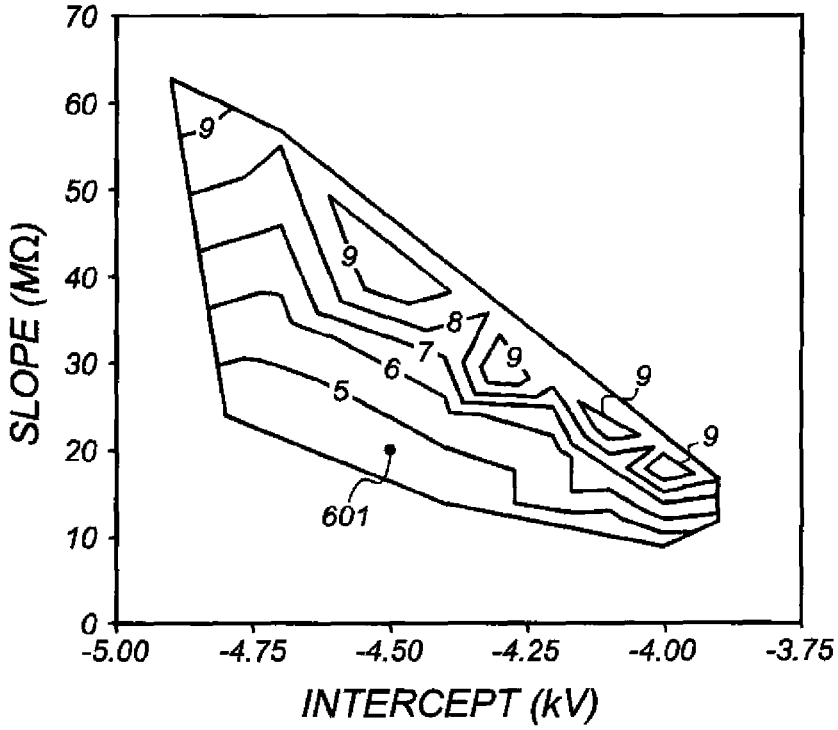
FIGS. 6A-6B are contour plots of hypothetical data.
Figure 6B:
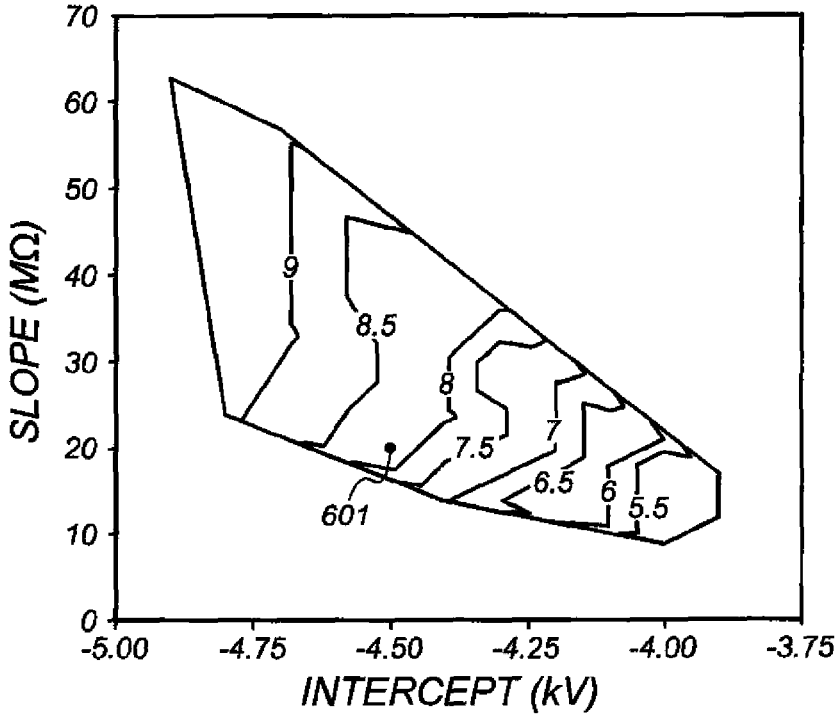

FIGS. 6A and 6B show contour plots of resistance (FIG. 6A) and spacing (FIG. 6B) of hypothetical data. The hypothetical data are for five spacings, and five resistances at each spacing. On each plot, the abscissa is the Y-intercept in kV, and the ordinate is the slope in MΩ (=V/μA). The contours in FIG. 6A designate resistance in MΩ, with granularity 1 MΩ; the contours in FIG. 6B designate spacing in mm, with granularity 0.5 mm. The granularities of the contours are selected for clarity of exposition and are not limiting. In various embodiments, the tolerance for charger spacing is +/−0.25 mm. For example, point 601 has an intercept of −4.5 kV and a slope of 20 MΩ. For the hypothetical system, point 601 indicates that the resistance is between 4 and 5 MΩ (FIG. 6A) and the spacing is between 8 and 8.5 mm. By storing these data in a lookup table or as an interpolation function, $R_{315}$ and $G_{337}$ can be determined from S and I, which are themselves determined from $I_{315}$ and $\Delta V_1$.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
111 imaging member
112 transfer member
113 transfer backup member
201 transfer nip
202 second transfer nip
206 photoreceptor
210 charging subsystem
211 meter
212 meter
213 grid
216 surface
220 exposure subsystem
225 development station
226 toning shell
227 magnetic core
230 developer supply
234 developer
236 toning zone
240, 245 power source
300 transfer unit
310 static-dissipative member
314 power source
315 resistance
320 second member
323 impedance
325 rollers
330 power source
335 electrode
336 transfer zone
337 gap
340 charger
342 corona wire
343 impedance
344 shell
345 resistance
347 current meter
348 grid
382 source
384 meter
386 control system
501, 541, 555, 570, 582 curve
601 point

The invention claimed is:

1. A transfer unit, comprising:

a) a rotatable static-dissipative member having a time-varying electrical property;

b) a second member adapted to transfer toner to or from the static-dissipative member;

c) a control system;

d) a power source responsive to the control system for selectively producing an electrostatic transfer field between the static-dissipative member and the second member, so that toner is transferred between the static-dissipative member and the second member; and e) a charger spaced apart from the static-dissipative member and adapted to selectively deposit charge thereon in response to the control system;

f) the control system being adapted to:

i) successively drive a plurality of different selected voltages or currents through the charger and measure a plurality of respective resulting charger currents or voltages;

ii) using the selected voltages or currents and the respective charger currents or voltages, automatically estimate a variation in the electrical property; and iii) cause the power source to produce an electric transfer field that transfers toner and compensates for the estimated variation.

2. The transfer unit according to claim 1, wherein the static-dissipative member is a blanket cylinder, the second member is a photoreceptor, and toner is transferred from the second member to the static-dissipative member.

3. The transfer unit according to claim 1, wherein the static-dissipative member is a blanket cylinder, the second member is a receiver, and toner is transferred from the static-dissipative member to the receiver.

4. The transfer unit according to claim 1, wherein the charger includes a corona charger, static string, or pin charger.

5. The transfer unit according to claim 1, wherein the power source produces a selected voltage between the static-dissipative member and the second member.

6. The transfer unit according to claim 1, wherein the power source produces a selected current between the static-dissipative member and the second member.

7. The transfer unit according to claim 1, wherein the electrical property is resistance.

8. The transfer unit according to claim 1, wherein the static-dissipative member is a roller or a belt.

9. The transfer unit according to claim 1, wherein the control system is further adapted to average multiple estimates of the variation of the electrical property and cause the power source to produce an electric transfer field that transfers toner and compensates for the averaged estimated variation.

10. The transfer unit according to claim 1, wherein the static-dissipative member and the second member are spaced apart by a selected gap spacing and the control system is further adapted to, using the selected voltages or currents and the respective charger currents or voltages, automatically estimate a variation in the gap spacing; and cause the power source to produce an electric toner-transfer field that transfers toner and compensates for the estimated variation in the gap spacing.

* * * * *